US011454460B2

(12) United States Patent
Espinheira Rio et al.

(10) Patent No.: US 11,454,460 B2
(45) Date of Patent: Sep. 27, 2022

(54) EXHAUST GAS RECIRCULATION HEAT EXCHANGER ASSEMBLY

(71) Applicant: Borgwarner Emissions Systems Spain, S.L.U., Vigo (ES)

(72) Inventors: Pedro Espinheira Rio, Foz do Sousa (PT); Daniel Peixoto, Vila do Conde (PT); Pablo Franco, Pontevedra (ES); Rodrigo Lamas, Pontevedra (ES)

(73) Assignee: Borgwarner Emissions Systems Spain, S.L.U.

( * ) Notice: Subject to any disclaimer, the term of this patent is extended or adjusted under 35 U.S.C. 154(b) by 246 days.

(21) Appl. No.: 16/848,285

(22) Filed: Apr. 14, 2020

(65) Prior Publication Data

US 2020/0325858 A1 Oct. 15, 2020

(30) Foreign Application Priority Data

Apr. 15, 2019 (EP) ..... 19382289

(51) Int. Cl.
*F28F 13/08* (2006.01)
*F28F 9/02* (2006.01)
(Continued)

(52) U.S. Cl.
CPC ..... *F28F 9/0282* (2013.01); *F02M 26/30* (2016.02); *F28F 13/08* (2013.01); *F28F 19/002* (2013.01);
(Continued)

(58) Field of Classification Search
CPC ..... F02M 26/29; F28F 9/0282; F28F 13/08; F28F 19/002; F28F 2225/04
See application file for complete search history.

(56) References Cited

U.S. PATENT DOCUMENTS 7,413,005 B2 * 8/2008 Heine ..... F28D 1/05366 165/173
10,047,703 B1 8/2018 Lee
(Continued)

FOREIGN PATENT DOCUMENTS

DE 102011085194 B3 3/2013
DE 202014103206 U1 * 11/2015 ..... F02B 29/0462
(Continued)

OTHER PUBLICATIONS

Machine translation of DE-202014103206-U1, accessed Feb. 10, 2022. (Year: 2022).*
(Continued)

*Primary Examiner* — Jonathan R Matthias
(74) *Attorney, Agent, or Firm* — Lerner, David, Littenberg, Krumholz & Mentlik, LLP

(57) ABSTRACT

An exhaust gas recirculation heat exchanger assembly that includes a tube, a fin structure, and a clip. The tube has first and second walls extending between a first lateral end and a second lateral end. The fin structure is received in the tube to form a cooling tube assembly. The cooling tube assembly defines a first channel between the first lateral end and a first fin of the fin structure, a second channel between the second lateral end and a second fin of the fin structure disposed opposite the first fin, and a plurality of intermediate channels extending between the first and second channels. The clip is coupled to the cooling tube assembly. The clip has at least one flow impeding portion being configured to impede a fluid flow through at least one of the first channel, the second channel, and one or more of the intermediate channels.

13 Claims, 5 Drawing Sheets

(51) Int. Cl.

| | |
|---|---|
| ***F02M 26/30*** | (2016.01) |
| ***F28F 19/00*** | (2006.01) |
| *F28D 1/04* | (2006.01) |
| *F28D 1/02* | (2006.01) |
| *F02M 26/32* | (2016.01) |

(52) U.S. Cl.
CPC ..... *F02M 26/32* (2016.02); *F28D 1/0408* (2013.01); *F28D 2001/0253* (2013.01)

(56) References Cited

U.S. PATENT DOCUMENTS

2005/0263263 A1* 12/2005 Merklein ..... F28D 1/05366 165/76
2015/0027419 A1 1/2015 Tischer
2017/0058842 A1* 3/2017 Grande Fernández ..... F28D 21/0003
2019/0072341 A1* 3/2019 Singh ..... F28F 9/013
2020/0011621 A1* 1/2020 Lacey ..... F28F 19/002

FOREIGN PATENT DOCUMENTS

| | | | |
|---|---|---|---|
| DE | 102017124482 | A1 | 10/2018 |
| DE | 102017111409 | A1 | 11/2018 |
| EP | 2372287 | A1 | 10/2011 |
| EP | 3086072 | A1 | 10/2016 |
| EP | 3135895 | A1 | 3/2017 |
| GB | 2433111 | A | 6/2007 |

OTHER PUBLICATIONS

Extended European Search Report for Application No. EP 19382289.7 dated Oct. 30, 2019, 4 pages.

* cited by examiner

EXHAUST GAS RECIRCULATION HEAT EXCHANGER ASSEMBLY

CROSS-REFERENCE TO RELATED APPLICATIONS

The present application claims the benefit of the filing date of European Patent Application No. 19382289.7, filed on Apr. 15, 2019, the disclosure of which is hereby incorporated herein by reference.

FIELD OF THE INVENTION

The present disclosure relates to an exhaust gas recirculation heat exchanger assembly.

BACKGROUND OF THE INVENTION

Internal combustion engines may be provided with an exhaust gas recirculation system (EGR) that is arranged to direct exhaust gases from an engine exhaust towards an engine intake. The exhaust gas recirculation system may include a heat exchanger assembly that is arranged to cool the exhaust gases prior to delivery to the engine intake. The cooled exhaust gases are added to the intake to lower the combustion temperature to inhibit the formation of environmental pollutants such as carbon monoxide (CO) and nitrogen oxides (NOx). Particulates within the cooled exhaust gases that are recirculated may deposit on surfaces of the heat exchanger assembly and impact the performance of the heat exchanger assembly.

BRIEF SUMMARY OF THE INVENTION

This section provides a general summary of the disclosure and is not a comprehensive disclosure of its full scope or all of its features.

Disclosed is an exhaust gas recirculation heat exchanger assembly that includes a tube, a fin structure, and a clip. The tube has a wall member. The wall member may define first and second walls and first and second lateral ends. The first and second walls can extend between the first lateral end of the tube and the second lateral end of the tube. The fin structure is received in the tube to form a cooling tube assembly. The cooling tube assembly defines a first channel between the first lateral end and a first fin of the fin structure, a second channel between the second lateral end and a second fin of the fin structure disposed opposite the first fin, and a plurality of intermediate channels extending between the first and second channels. The clip is coupled to the cooling tube assembly. The clip has at least one flow impeding portion being configured to impede a fluid flow through at least one of the first channel, the second channel, and one or more of the intermediate channels.

In some forms, the clip can be formed of a sheet metal material, such as steel or aluminum, and is resiliently engaged to at least one of the tube and the fin structure. The clip can be additionally or alternately bonded to the cooling tube assembly, for example via solder, fastening, welding, brazing, adhesive, or the like.

In some forms, the flow impeding portions extend at least partially into the tube.

In some forms, the clip includes a first member extending into the first channel and a second member extending into second channel.

In some forms, the flow impeding portions comprises a first projection extending outwardly from the first member towards the first lateral end.

In some forms, the first projection engages an inner surface of the first lateral end.

In some forms, the flow impeding portions further comprises a second projection extending outwardly from the second member towards the second lateral end.

In some forms, the second projection engages an inner surface of the second lateral end.

In some forms, a joining member extends between and connects the first member to second member.

In some forms, a first support member extends from a first end of the joining member and a second support member extends from a second end of the joining member.

In some forms, a third member extends from the first support member and a fourth member extends from the second support member.

In some forms, a blocking member is disposed between the first member and the second member. The blocking member can be disposed laterally between the first and second members.

In some forms, the blocking member is arranged to inhibit a fluid flow through at least a portion of the plurality of channels.

In some forms, the flow impeding portion comprises a blocking member that is arranged to inhibit a fluid flow through at least a portion of the plurality of channels.

In some forms, the clip further comprises a first member disposed on the first wall or the second wall of the tube.

In some forms, the clip further comprises a second member disposed spaced apart from and disposed opposite the first member, wherein the blocking member extends between the first member and the second member.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Referring now to the Figures, where the present disclosure will be described with reference to specific embodiments, without limiting same, it is to be understood that the disclosed embodiments are merely illustrative of the present disclosure that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
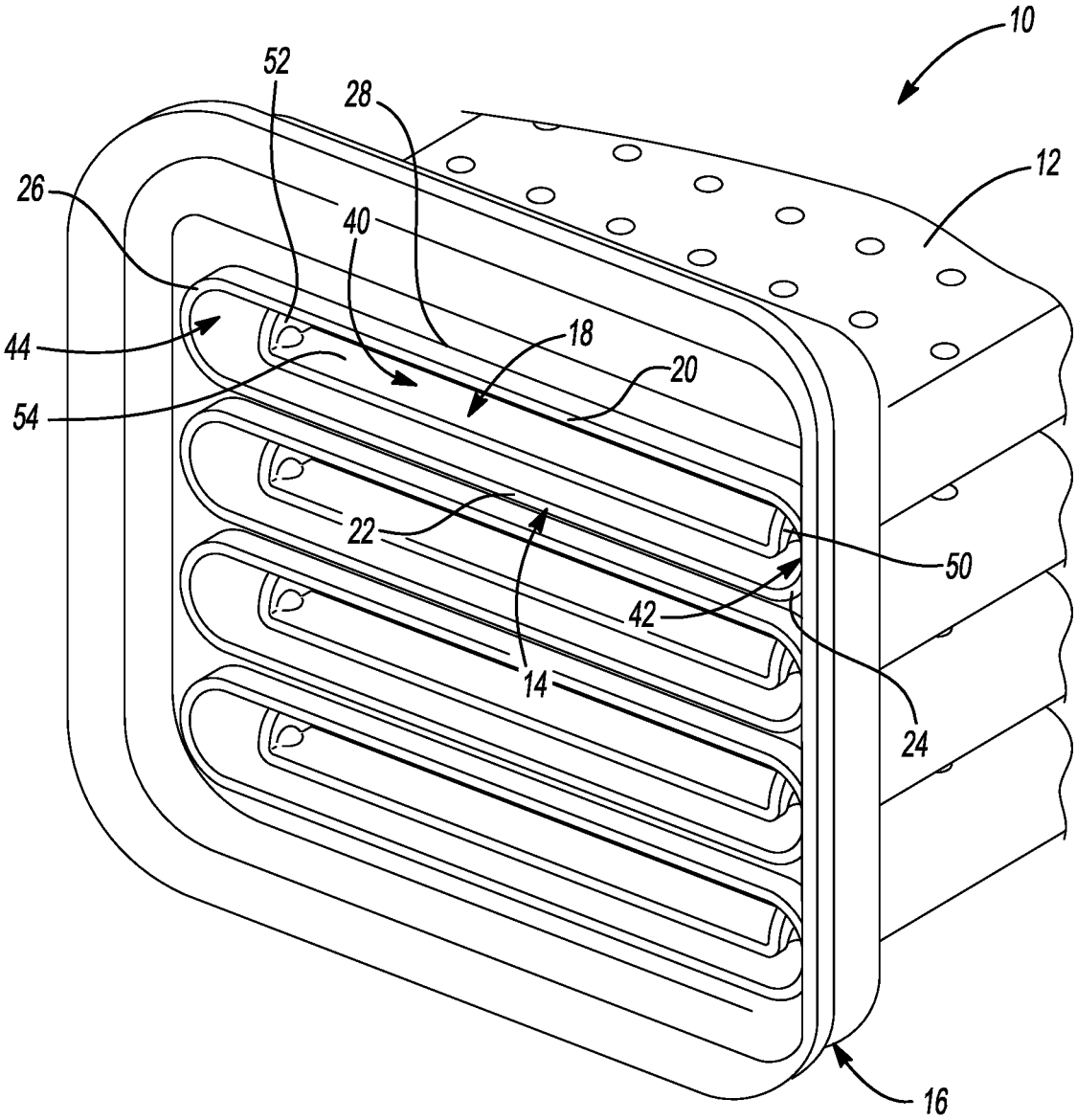
FIG. 1 is a perspective view of a portion of an exemplary exhaust gas recirculation (EGR) heat exchanger assembly constructed in accordance with the teachings of the present disclosure.

Referring to FIG. 1, a partial view of a portion of an outlet region of a heat exchanger assembly is shown. The heat exchanger assembly may be an exhaust gas recirculation (EGR) heat exchanger assembly 10 that is arranged to cool a flow of exhaust gases received from an internal combustion engine for delivery to an intake of the internal combustion engine. The exhaust gas recirculation heat exchanger assembly 10 may include a tube 12, a fin structure 14, a header 16, and a clip 18.

A shell or cooling jacket may be disposed about the exhaust gas recirculation heat exchanger assembly 10 and end caps (e g manifolds) may be disposed at distal ends of the exhaust gas recirculation heat exchanger assembly 10. The shell or cooling jacket and the end caps have been removed from the figures for clarity.

The tube 12 may be provided as part of a plurality of tubes that are arranged to direct the exhaust gas flow through the exhaust gas recirculation heat exchanger assembly 10. The plurality of tubes 12 may be stacked relative to each other and spaced apart from each other by the header 16.

Each tube 12 may be flat or planar tube having a first wall 20, a second wall 22 disposed opposite the first wall 20, a first lateral end 24, and a second lateral end 26. The first wall 20 is spaced apart from and is disposed generally parallel to the second wall 22. The first lateral end 24 extends between first ends of the first wall 20 and the second wall 22. The second lateral end 26 extends between second ends, opposite the first ends, of the first wall 20 and the second wall 22 such that the second lateral end 26 is disposed opposite the first lateral end 24.

Each tube 12 extends at least partially through an opening 28 of the header 16. The first and second walls 20 and 22 and/or the lateral ends 24 and 26 of the tube 12 may engage internal surfaces of the opening 28. In the example provided, the tubes 12 have a hollow oval lateral cross-sectional shape.

The fin structure 14 is corrugated and is disposed within the tube 12. The combination of the tube 12 and the fin structure 14 defines a cooling tube assembly. The corrugated configuration of the fin structure 14 provides a plurality of longitudinally extending fins 30 that include a first fin 32, which is disposed proximate or adjacent the first lateral end 24, and a second fin 34 that is disposed proximate or adjacent the second lateral end 26. The fin structure 14 and the tube 12 cooperate to define a plurality of longitudinally extending intermediate channels 40 that are disposed laterally (i.e., in a side to side manner) between the first and second fins 32 and 34. Each of the intermediate channels 40 is bounded by the tube 12 and a pair of adjacent and connected fins 30. The exhaust gas flows through the plurality of intermediate channels 40 to facilitate the transfer of heat between the exhaust gas and the cooling fluid that flows about or along the tube 12.

A first channel 42 is at least partially defined between the first fin 32 of the plurality of fins 30 and the first lateral end 24 of the tube 12. A second channel 44 is at least partially defined between the second fin 34 of the plurality of fins 30 and the second lateral end 26 of the tube 12. The first channel 42 and the second channel 44 may be arranged as bypass channels that enable the exhaust gas to bypass the plurality of intermediate channels 40.

The cross-sectional area or flow area of each channel of the plurality of intermediate channels 40 may be less than the cross-sectional area or flow area of the first channel 42 or the second channel 44. The cross-sectional area or flow area of the plurality of intermediate channels 40, the first channel 42, and/or the second channel 44 may be varied to achieve specific flow rate requirements and efficiency of the exhaust gas recirculation heat exchanger assembly 10. Particulates within the exhaust gases may deposit on surfaces of fins of the plurality of fins 30 or on internal surfaces of the tube 12 effectively reducing the cross-sectional area or flow area of the plurality of intermediate channels 40. The deposition of particulates is commonly referred to as fouling. The reduction in the cross-sectional area or flow area reduces a fluid flow of the exhaust gases through the plurality of intermediate channels 40 and may lead to an increase in fluid flow of the exhaust gases through the first and second (bypass) channels 42, 44. The increase in fluid flow of the exhaust gases through the first and second (bypass) channels 42, 44 may impact the efficiency of the exhaust gas recirculation heat exchanger assembly 10.

The clip 18 may include at least one flow impeding portion that may increase a fluid flow or fluid velocity of the exhaust gases that flows through the plurality of intermediate channels 40 by locally reducing the cross-sectional area or flow area of at least a portion of the plurality of intermediate channels 40, the first channel 42, and/or the second channel 44. The increase in fluid velocity through the plurality of intermediate channels 40 may inhibit or reduce fouling within the exhaust gas recirculation heat exchanger assembly 10.

The clip 18 is spaced apart from surfaces of the header 16, as shown in the figures. The clip 18 may be provided with flow impeding portions that extend at least partially into the tube 12 and in some arrangements, into the intermediate, first and second channels 40, 42 and 44. Referring to FIGS. 2A-4D, the clip 18 may include a first member 50, a second member 52, and a joining member 54 that extends between proximal ends of the first member 50 and the second member 52.

The first member 50 is disposed parallel to but not coplanar with the second member 52. The first member 50 is arranged to extend into the first channel 42, as shown in FIGS. 1, 2B, 3B, and 4B. The first member 50 may have an arm that may be arranged as a generally planar member that is disposed parallel to at least a portion of the first fin 32 and is disposed generally perpendicular to the first wall 20 and the second wall 22 of the tube 12.

The first member 50 also may include a first flow impeding portion or a first projection 60 that may be resiliently coupled to the arm of the first member 50. The first projection 60 extends towards an interior or inner surface of the first lateral end 24 of the tube 12 and is arranged as a flow impeding portion that at least partially blocks or reduces the flow area of the first channel 42. An end of the first projection 60 that is disposed proximate the inner surface of the first lateral end 24 of the tube 12 may have a shape that conforms with or is complimentary to the shape of the first lateral end 24 of the tube 12.

Figure 2A:
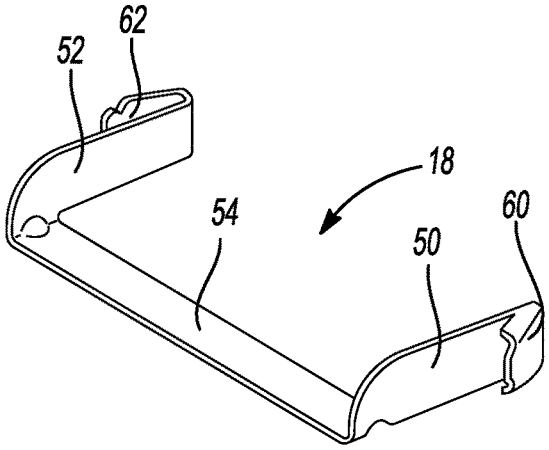
FIG. 2A is a perspective view of a portion of the EGR heat exchanger assembly of FIG. 1, illustrating a clip in more detail.
Figure 2B:
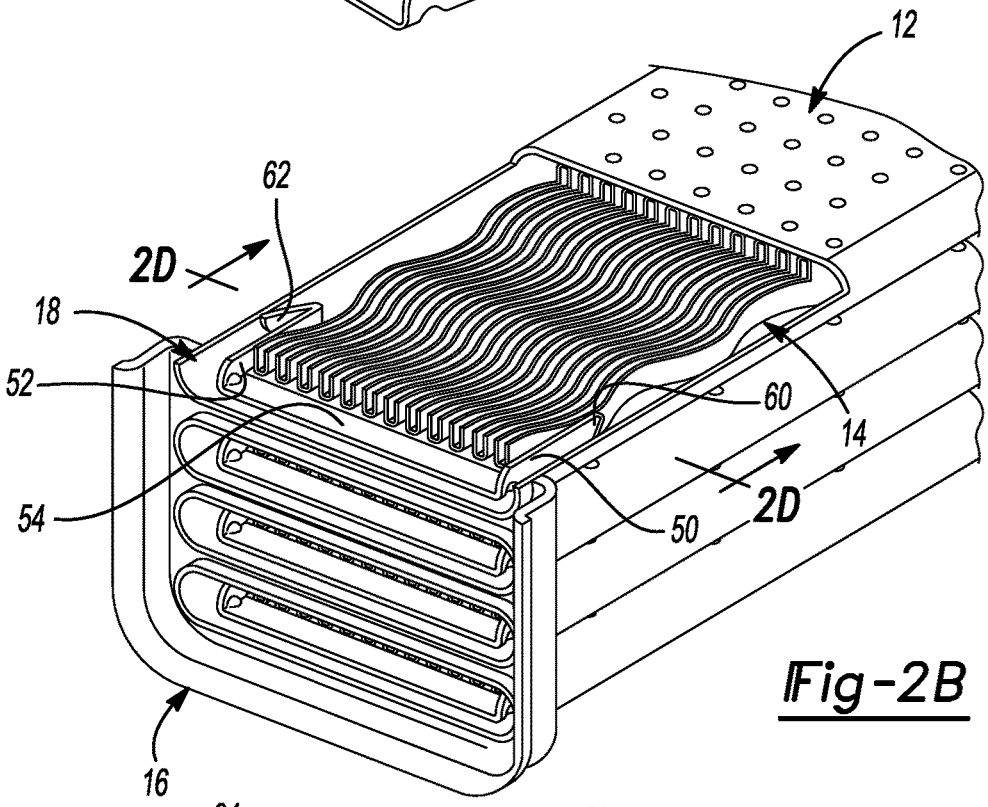
FIG. 2B is a perspective, partly broken away view of the EGR heat exchanger assembly of FIG. 1.
Figure 2C:
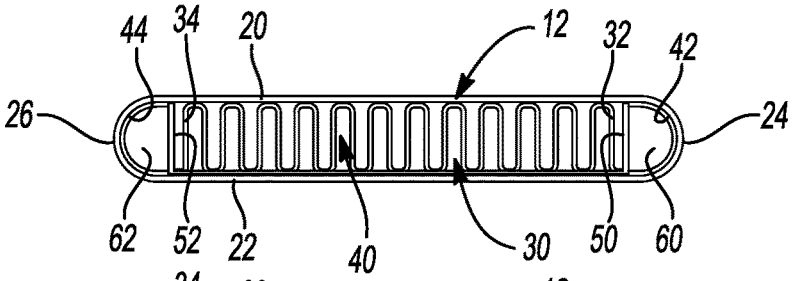
FIG. 2C is a front view of a portion of the EGR heat exchanger assembly of FIG. 1, illustrating an open end of a cooling tube assembly in more detail.
Figure 2D:
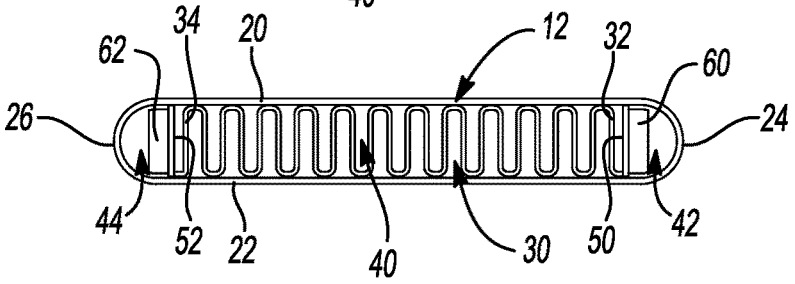
FIG. 2D is a sectional view of the cooling tube assembly taken along the line 2D-2D of FIG. 2B.

The first projection 60 may extend from or proximate a distal end of the arm of the first member 50. The first projection 60 may be disposed in a non-parallel and non-perpendicular relationship with respect to the arm of the first member 50 and extend towards the proximal end of arm of the first member 50 with increasing distance away from the intersection of the arm and the first projection 60. The first projection 60 may engage an interior surface or inner surface of the first lateral end 24 of the tube 12 to inhibit a fluid flow through the first channel 42, as shown in FIGS. 2C, 3C, and 4C. The first projection 60 may extend towards but be spaced apart from an inner surface of the first lateral end 24 of the tube 12 to reduce or restrict a fluid flow through the first channel 42, as shown in FIGS. 2D and 4D.

The second member 52 is arranged to extend into the second channel 44, as shown in FIGS. 1, 2B, 3B, and 4B. The second member 52 may have an arm that may be arranged as a generally planar member. The arm of the second member 52 may be disposed parallel to at least a portion of the second fin 34 and may be disposed generally perpendicular to the first wall 20 and the second wall 22 of the tube 12.

The second member 52 also may include a second flow impeding portion or a second projection 62 that may be resiliently coupled to the arm of the second member 52. The second projection 62 extends towards an interior surface or inner surface of the second lateral end 26 of the tube 12 and is arranged as a flow impeding portion that at least partially blocks or reduces the flow area of the second channel 44. An end of the second projection 62 that is disposed proximate the inner surface of the second lateral end 26 of the tube 12 may have a shape that conforms with or is complimentary to the shape of the second lateral end 26 of the tube 12.

The second projection 62 may extend from or proximate a distal end of the arm of the second member 52. The second projection 62 may be disposed in a non-parallel and non-perpendicular relationship with respect to the arm of the second member 52 and extend towards the proximal end of the arm of the second member 52 with increasing distance away from the intersection of the arm and the second projection 62. The second projection 62 may engage an interior surface or inner surface of the second lateral end 26 of the tube 12 to inhibit a fluid flow through the second channel 44, as shown in FIGS. 2C, 3C, and 4C. The second projection 62 may extend toward but be spaced apart from an interior surface or inner surface of the second lateral end 26 of the tube 12 to reduce or restrict a fluid flow through the second channel 44, as shown in FIGS. 2D and 4D.

The reduction in cross-sectional area or flow area of the first channel 42 and/or the second channel 44 by the first projection 60 and the second projection 62, respectively, may increase the fluid velocity through the plurality of intermediate channels 40, inhibiting or reducing fouling. The reduction or inhibiting of fouling may facilitate the thermal efficiency of the exhaust gas recirculation heat exchanger assembly 10.

The joining member 54 extends between the arm of the first member 50 and the arm of the second member 52. The joining member 54 extends proximate, proximal ends of the first member 50 and the second member 52. The joining member 54 may be disposed transverse of the arm of the first member 50 and the arm of the second member 52. The joining member 54 may be disposed within the tube 12 and engage the first wall 20 or the second wall 22 of the tube 12, as shown in FIGS. 1, 2B, 3B, and 4B.

Figure 3A:
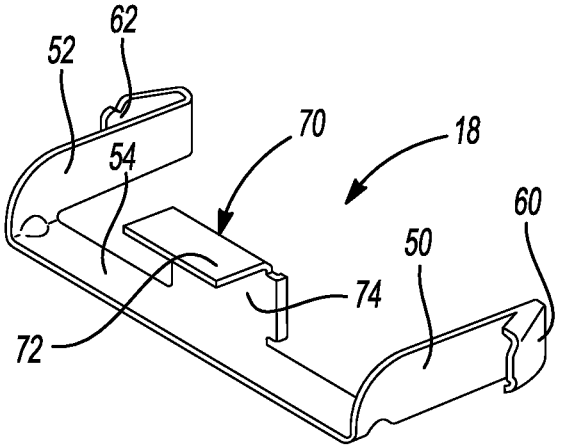
FIG. 3A is a perspective view of a first alternately constructed clip.
Figure 3B:
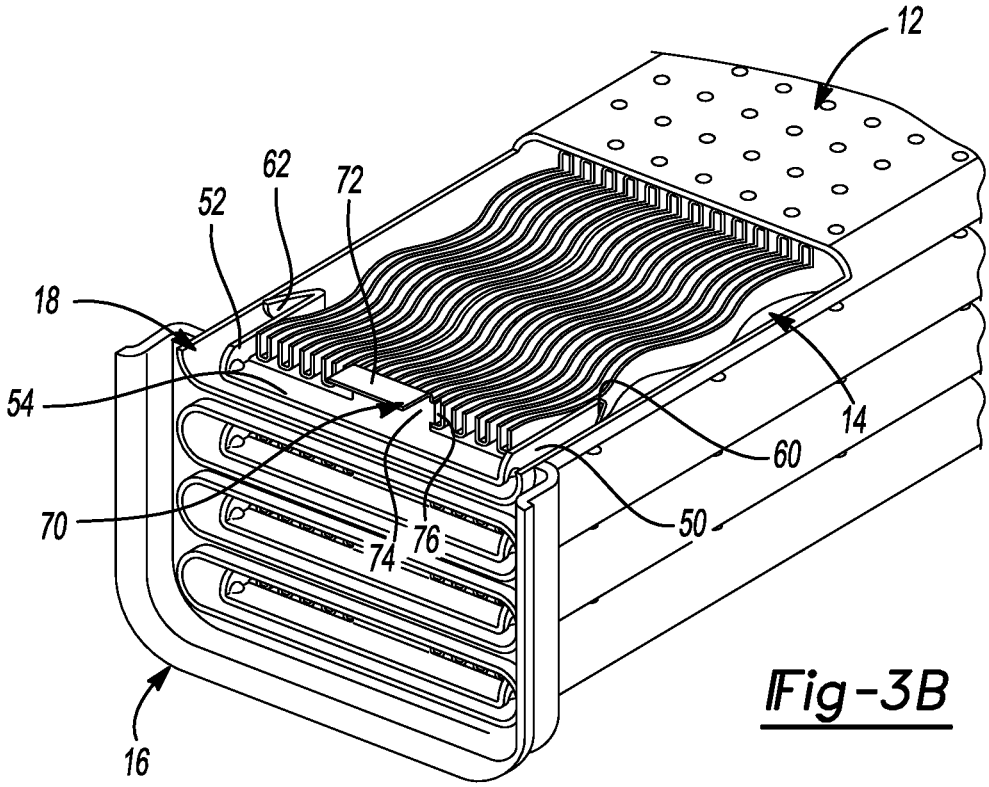
FIG. 3B is a perspective, partly broken away view of an EGR heat exchanger assembly with the clip of FIG. 3A.
Figure 3C:
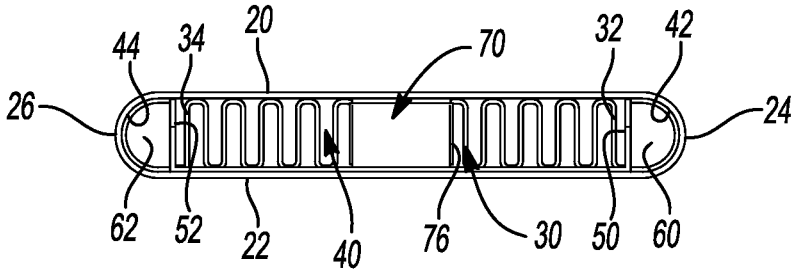
FIG. 3C is a front view of a portion of the EGR heat exchanger assembly of FIG. 3B, illustrating an open end of a cooling tube assembly.
Figure 4A:
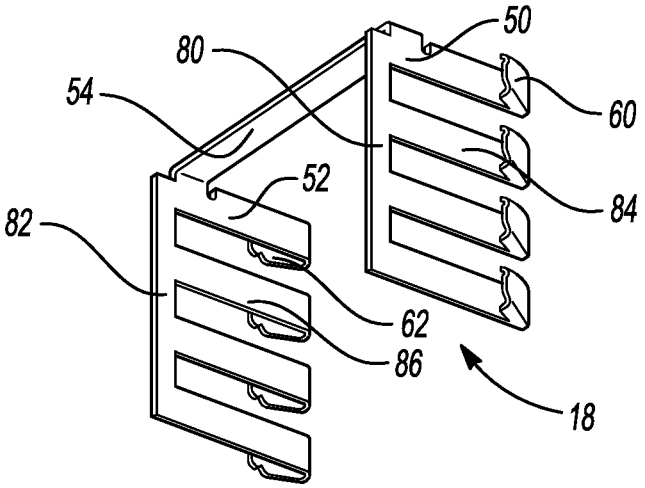
FIG. 4A is a perspective view of a second alternately constructed clip.
Figure 4B:
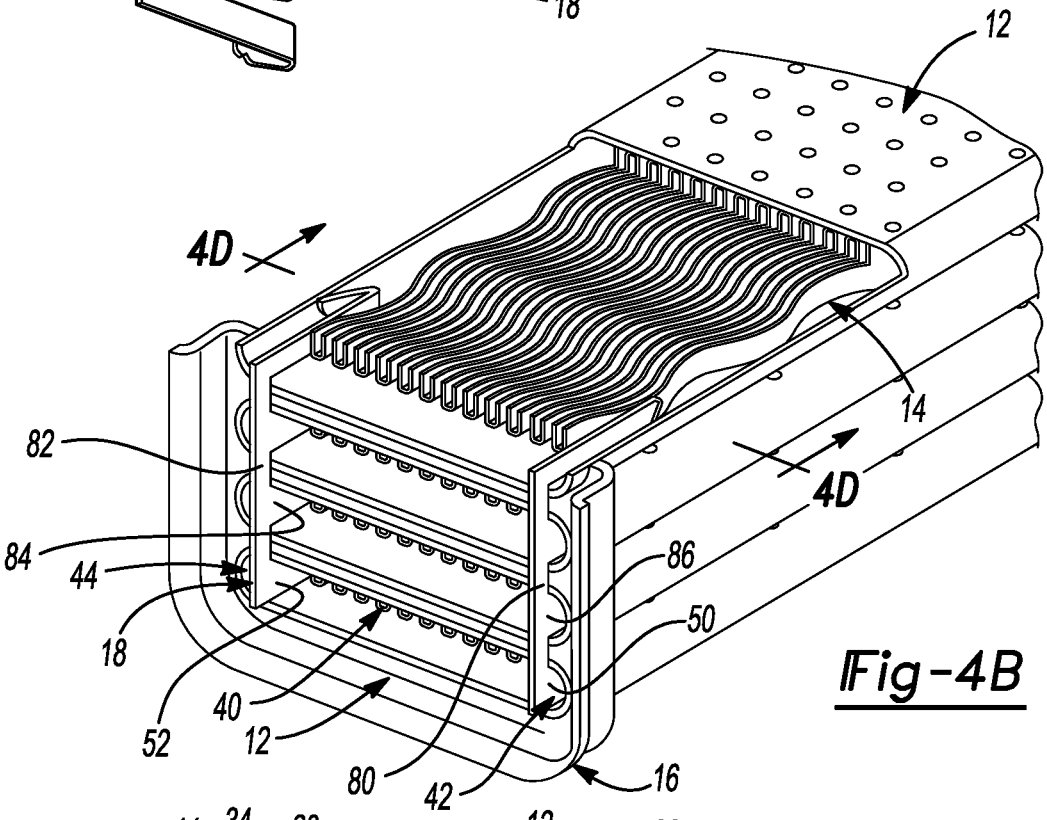
FIG. 4B is a perspective, partly broken away view of an EGR heat exchanger assembly with the clip of FIG. 4A.
Figure 4C:
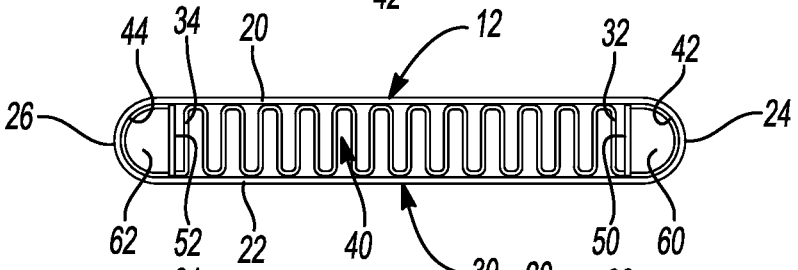
FIG. 4C is a front view of a portion of the EGR heat exchanger assembly of FIG. 4B, illustrating an open end of a cooling tube assembly.
Figure 4D:
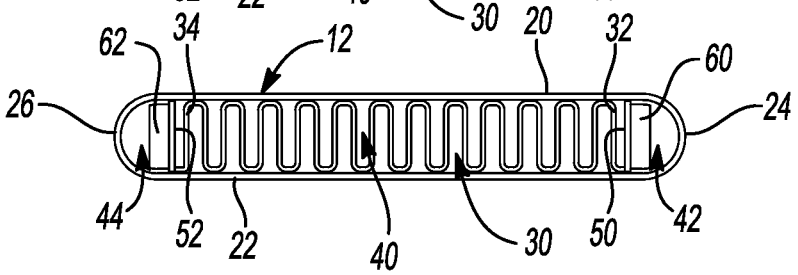
FIG. 4D is a sectional view of the cooling tube assembly taken along the line 4D-4D of FIG. 4B.

Referring to FIGS. 3A-3C, a blocking member 70 may extend from the joining member 54 and may function as another flow impeding portion along with the first projection 60 and the second projection 62. The blocking member 70 is positioned or disposed laterally between the first member 50 and the second member 52. The blocking member 70 extends along the first wall 20 or the second wall 22 of the tube 12 to block or inhibit a fluid flow through at least a portion of the plurality of intermediate channels 40. The blocking member 70 works in conjunction with the first projection 60 and the second projection 62 to optimize the distribution of the exhaust gases across the non-blocked plurality of intermediate channels 40.

The blocking member 70 may include a flow impeding portion or a first portion 74 and a second portion 72. The first portion 74 extends from the joining member 54 and may be disposed generally perpendicular to the joining member 54. The first portion 74 is arranged to block or inhibit a fluid flow through a portion of the plurality of channels 40. Distal ends of the first portion 74 may be provided with tabs 76 that engage or are disposed between adjacent fins of the plurality of fins 30 to facilitate positioning of the blocking member 70 relative to the first fin 32 and the second fin 34. The second portion 72 is disposed opposite the joining member 54 and is disposed generally parallel to the joining member 54. The second portion 72 facilitates the joining of the clip 18 to one or both of the first and second walls 20, 22 of the tube 12.

Referring to FIGS. 4A-4D, the clip 18 may be arranged to accommodate additional members via support members 80, 82 that extend from the joining member 54. A first support member 80 may extend from a first end of the joining member 54 and a second support member 82 may extend from a second end of the joining member 54. The first support member 80 is disposed parallel to the second support member 82.

The first member 50 and a third member 84 may each extend from the first support member 80 and may be disposed parallel to each other. The third member 84 may have a substantially similar configuration as the first member 50. A side of the tube 12, either the first wall 20 or the second wall 22, may be disposed between the first member 50 and the third member 84. The second member 52 and a fourth member 86 may each extend from the second support member 82 and may be disposed parallel to each other. The fourth member 86 may have a substantially similar configuration as the second member 52. A side of the tube 12, either the first wall 20 or the second wall 22, may be disposed between the second member 52 and the fourth member 86. It is also contemplated that additional members may be attached to the clip 18 that extend from the first and second support members 80, 82, respectively.

The additional members attached to the clip 18 may facilitate installation of the clip 18 by providing a unitary or single piece for installation onto the tube 12. Furthermore, the members of the clip 18 may extend into separate cooling tube assemblies to reduce the cross-sectional area of their respective first and second channels 42, 44 to increase the fluid velocity through the plurality of intermediate channels 40 of the respective cooling tube assembly.

Figure 5A:
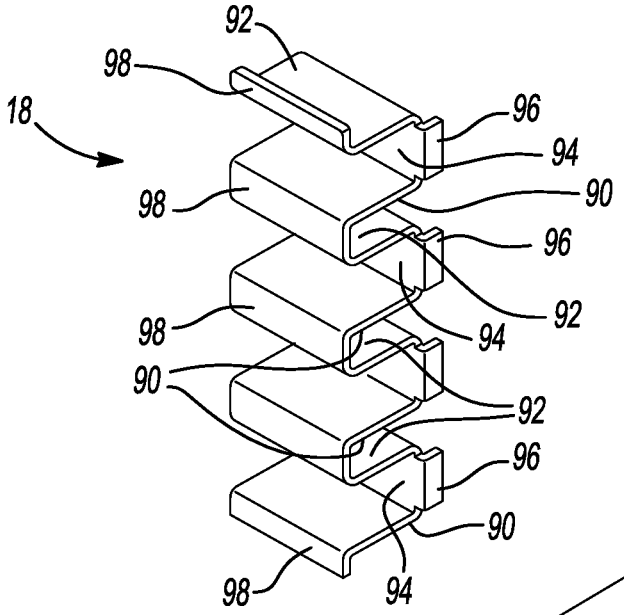
FIG. 5A is a perspective view of a third alternately constructed clip.
Figure 5B:
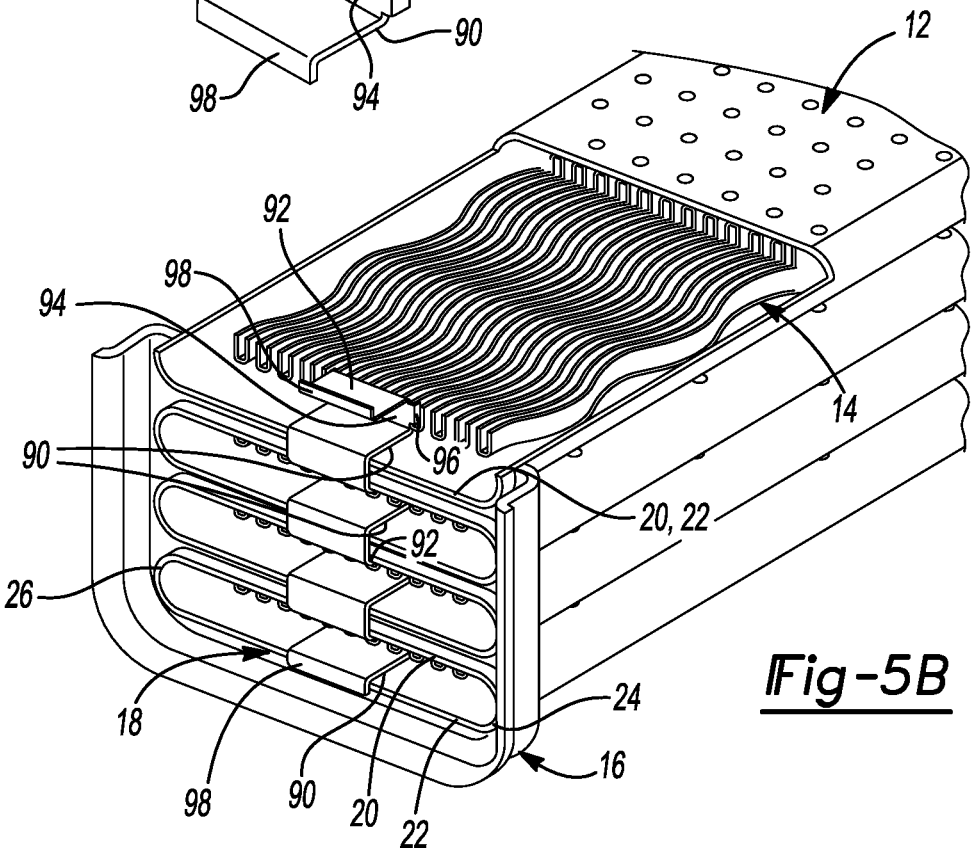
FIG. 5B is a perspective, partly broken away view of an EGR heat exchanger assembly with the clip of FIG. 5A.
Figure 5C:
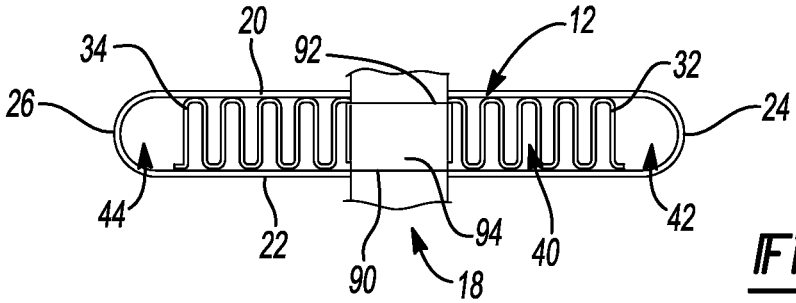
FIG. 5C is a front view of a single clip connected to a portion of the EGR heat exchanger assembly.

Referring to FIGS. 5A-5C, the clip 18 may be located centrally, such that the clip 18 is disposed between the first channel 42 and the second channel 44 and does not reduce or inhibit fluid flow through the first channel 42 or the second channel 44 but rather is arranged with a flow impeding portion that is disposed within the tube 12 to at least partially block or inhibit a fluid flow through at least a portion of the plurality of intermediate channels 40. The centrally located clip 18 may be used with or instead of clip features that reduce or inhibit fluid flow through the first channel 42 or the second channel 44.

The clip 18 may include a first member 90, a second member 92, and a blocking member or third member 94. The first member 90 may be disposed within the tube 12 and may be disposed on the first wall 20 or the second wall 22 of the tube 12. The second member 92 may be disposed within the tube 12 and may be disposed on the other of the first wall 20 or the second wall 22 of the tube 12 such that the second member 92 is disposed opposite the first member 90. The blocking member or third member 94 extends between the first member 90 and the second member 92. The third member 94 functions as a flow impeding portion that is arranged to block or inhibit a fluid flow through at least a portion of the plurality of intermediate channels 40 of the plurality of fins 30. While the clip 18, has been described illustrated in FIG. 5C as a single clip, additional members and blocking members may be provided with the clip 18 such that the clip 18 includes multiple clips, as illustrated in FIGS. 5A and 5B.

Distal ends of the third member 94 may be provided with tabs 96 that engage or are disposed between adjacent fins of the plurality of fins 30 to facilitate positioning of the third member 94 relative to the first fin 32 and the second fin 34.

Support members 98 may be provided to connect clips together to facilitate the assembly or mounting process of the clip 18 on the tube 12. A support member 98 may extend between ends of the first member 90 and the second member 92 such that the support member 98 is disposed opposite or spaced apart from the blocking member or third member 94. A support member 98 may extend from ends of the first member 90 or the second member 92 such that the support member 98 extends over an end of the tube 12 to facilitate a connection between the clip 18 and a tube 12 of the exhaust gas recirculation heat exchanger assembly 10. For example, a support member 98 may extend from the first member 90 to facilitate a connection of the clip 18 to the second wall 22 of the tube 12 and/or from the second member 92 to facilitate a connection of the clip 18 to the first wall 20 of the tube 12.

The clip 18 arranged centrally may facilitate an increase in fluid velocity through the unblocked portions of the plurality of intermediate channels 40, the first channel 42, and the second channel 44. This increased flow through the first and second channels 42 and 44 and the intermediate channels 40 may also inhibit fouling.

While the present disclosure has been described in detail in connection with only a limited number of embodiments, it should be readily understood that the present disclosure is not limited to such disclosed embodiments. Rather, the present disclosure may be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be limited by the foregoing description.

The invention claimed is:

1. An exhaust gas recirculation heat exchanger assembly comprising:

a tube having first and second walls extending between a first lateral end and a second lateral end;

a fin structure received in the tube to form a cooling tube assembly, the cooling tube assembly defining a first channel, a second channel, and a plurality of intermediate channels that extend between the first and second channels, the first channel being disposed between the first lateral end of the tube and a first fin of the fin structure, the second channel being disposed between the second lateral end of the tube and a second fin of the fin structure disposed opposite the first fin; and a clip coupled to the cooling tube assembly, the clip having at least one flow impeding portion arranged to inhibit a fluid flow through at least one of the first channel, the second channel, or the plurality of intermediate channels, wherein the clip includes a first member which extends into the first channel and a second member that extends into the second channel, wherein the flow impeding portions comprise a first projection that extends outwardly from the first member towards the first lateral end, the first projection being resiliently coupled to the first member.

2. The exhaust gas recirculation heat exchanger assembly of claim 1, wherein the first projection engages an inner surface of the first lateral end.

3. The exhaust gas recirculation heat exchanger assembly of claim 1, wherein the at least one flow impeding portion further comprises a second projection that extends outwardly from the second member towards the second lateral end.

4. The exhaust gas recirculation heat exchanger assembly of claim 3, wherein the second projection engages an inner surface of the second lateral end.

5. The exhaust gas recirculation heat exchanger assembly of claim 1, wherein a joining member extends between and connects the first member and the second member.

6. The exhaust gas recirculation heat exchanger assembly of claim 5, wherein the clip includes a first support member, which extends from a first end of the joining member, and a second support member that extends from a second end of the joining member to accommodate additional members.

7. The exhaust gas recirculation heat exchanger assembly of claim 6, wherein the clip includes a third member that extends from the first support member, and a fourth member that extends from the second support member.

8. The exhaust gas recirculation heat exchanger assembly of claim 5, wherein the at least one flow impeding portion comprises a blocking member that is disposed between the first member and the second member.

9. The exhaust gas recirculation heat exchanger assembly of claim 8, wherein the blocking member comprises a first portion that is arranged to inhibit a fluid flow through at least a portion of the plurality of intermediate channels.

10. The exhaust gas recirculation heat exchanger assembly of claim 1, wherein the at least one flow impeding portion comprises a blocking member that is arranged to inhibit a fluid flow through at least a portion of the plurality of intermediate channels.

11. The exhaust gas recirculation heat exchanger assembly of claim 10, wherein the clip further comprises a first member disposed on the first wall or the second wall of the tube.

12. The exhaust gas recirculation heat exchanger assembly of claim 11, wherein the clip further comprises a second member that is spaced apart from and disposed opposite the first member, and wherein the blocking member extends between the first member and the second member.

13. The exhaust gas recirculation heat exchanger assembly of claim 1, wherein the flow impeding portions extend at least partially into the tube.

* * * * *